US009394760B2

(12) United States Patent
Merron

(10) Patent No.: US 9,394,760 B2
(45) Date of Patent: Jul. 19, 2016

(54) CLUTCH APPARATUS AND METHOD FOR RESISTING TORQUE

(71) Applicant: Halliburton Energy Services, Inc., Houston, TX (US)

(72) Inventor: Matthew James Merron, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

(21) Appl. No.: 13/958,094

(22) Filed: Aug. 2, 2013

(65) Prior Publication Data

US 2015/0034331 A1 Feb. 5, 2015

(51) Int. Cl.
*E21B 34/14* (2006.01)
*E21B 33/14* (2006.01)

(52) U.S. Cl.
CPC ..... *E21B 34/14* (2013.01); *E21B 33/146* (2013.01)

(58) Field of Classification Search
CPC ..... E21B 34/14; E21B 33/16; E21B 33/146
See application file for complete search history.

(56) References Cited

U.S. PATENT DOCUMENTS 2,435,016 A * 1/1948 Pitts ..... E21B 33/146 137/68.16
2,928,470 A * 3/1960 Baker ..... E21B 33/14 166/154
4,069,573 A 1/1978 Rogers, Jr. et al.
4,190,112 A * 2/1980 Davis ..... E21B 17/14 166/153
4,368,571 A 1/1983 Cooper, Jr.
4,842,062 A * 6/1989 Schneider ..... E21B 34/14 166/154
5,178,216 A * 1/1993 Giroux ..... E21B 23/02 166/216
5,314,015 A * 5/1994 Streich ..... E21B 33/127 166/154
5,348,089 A * 9/1994 Brandell ..... E21B 33/146 166/154
6,651,743 B2 * 11/2003 Szarka ..... E21B 33/146 166/153
7,216,700 B2 5/2007 Roberts
7,419,009 B2 9/2008 Cook
8,230,926 B2 * 7/2012 Rogers ..... E21B 33/146 166/212
8,800,655 B1 * 8/2014 Bailey ..... E21B 33/146 166/177.4
2002/0070032 A1 6/2002 Maguire et al.
2011/0192607 A1 8/2011 Hofman et al.
2011/0278017 A1 11/2011 Themig et al.
2011/0303422 A1 12/2011 Soni et al.
2013/0048290 A1 2/2013 Howell et al.
2013/0146144 A1 6/2013 Joseph et al.

FOREIGN PATENT DOCUMENTS

WO WO-2015017698 A1 2/2015

OTHER PUBLICATIONS

"International Application Serial No. PCT/US2014/049233, International Search Report mailed Nov. 21, 2014", 3 pgs.
"International Application Serial No. PCT/US2014/049233, Written Opinion mailed Nov. 21, 2014", 8 pgs.
Merron, Matthew J., "Method and Apparatus for Restricting Fluid Flow in a Downhole Tool", U.S. Appl. No. 13/953,122, filed Aug. 2, 2013, 36 pgs.
"International Application Serial No. PCT/US2014/049233, International Preliminary Report on Patentability mailed Feb. 11, 2016", 10 pgs.

* cited by examiner

*Primary Examiner* — Robert E Fuller
(74) *Attorney, Agent, or Firm* — Schwegman, Lundberg & Woessner, P.A.; John W. Wustenberg

(57) ABSTRACT

A clutch employed in a tool string includes an annular housing and an annular sleeve arranged and moveable within the housing. The sleeve is configured to move into engagement with the housing to inhibit relative rotation and axial translation between the housing and the sleeve.

19 Claims, 11 Drawing Sheets

CLUTCH APPARATUS AND METHOD FOR RESISTING TORQUE

BACKGROUND

This disclosure relates generally to clutches employed in downhole mill out operations.

Subterranean well operations employ a variety of tools downhole for different purposes. For example, downhole valves can be employed at different locations of a tool string for a variety of purposes including to isolate sections of conduit of the tool string within a wellbore. Such valves can be individually actuated opened/closed to isolate different portions of the string of conduits along the length of the wellbore.

The operation of tools downhole in a tool string can necessitate different mill out operations within the conduit of the tool string. For example, it may be necessary after carrying out operations with a downhole tool to remove some portion of the tool to clear the conduit for additional operations within the tool string. In the case of ball seat valves, there can be a need to remove the ball, the seat, and/or other parts of the valve from the conduit after the valve has been actuated. In such cases, there may be a need to employ clutches to resist torque during the mill out operation to remove part or all of the valve (or other tool) from the conduit.

Clutches in these applications can be used to resist torque during the mill out operation so that the component that is being milled out does not rotate relative to the conduit within which the component is arranged. Currently many applications use clutches machined in situ, which may suffer from a number of disadvantages.

SUMMARY

Examples according to this disclosure include a clutch apparatus configured for use in a downhole tool string. The clutch can be used in to resist torque during a mill out operation so that the component that is being milled out does not rotate relative to the conduit within which the component is arranged. Clutches in accordance with this disclosure can include an annular housing including a shoulder extending radially inward from an inner surface of the housing and an annular sleeve received within the housing and configured to move longitudinally from a first position toward a second position within the housing in response to an applied force. The annular sleeve includes at least one tab protruding longitudinally from a first end of the sleeve. The annular sleeve is configured to allow the at least one tab of the sleeve to engage and at least partially penetrate the shoulder of the housing to inhibit relative rotation between the housing and sleeve.

The sleeve of the clutch can include one, two, three or more tabs protruding from, and distributed around, a circumference of the first end of the sleeve. An actuation force can act upon the sleeve of the clutch to cause the sleeve to engage and clutch to the housing. In one example, the sleeve of the clutch is also the sleeve employed in a ball seat valve. In some such cases, the force that opens the ball seat valve can also cause the sleeve of the clutch to engage and clutch to the housing. In other examples, a separate actuation mechanism can be employed to engage the clutch.

The details of one or more examples of the disclosure are set forth in the accompanying drawings and the description below.

DETAILED DESCRIPTION

Figure 1:
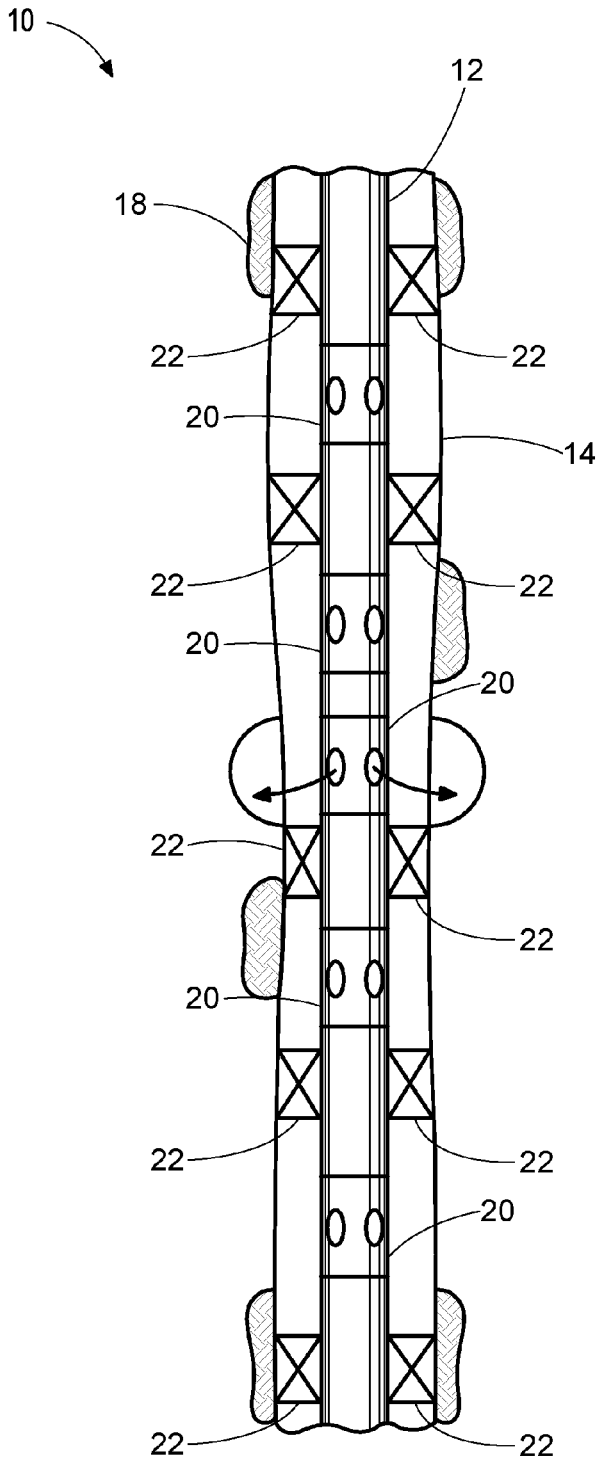
FIG. 1 schematically depicts an example fracturing system including a tool string arranged within a wellbore that passes through a number of layers of a formation of a well.

A challenge that is encountered in fracturing systems and other downhole applications is the need to clutch components downhole for mill out operations. One example of such an application is milling out one or more components of a valve that is actuated within a conduit of a tool string. For example, the ball, seat, or other components of a ball seat valve may be milled out after the valve has been actuated to carry out fracturing operations.

Clutches are used in these applications to resist torque during the mill out operation so that the component that is being milled out does not rotate relative to the conduit within which the component is arranged. Currently many applications use clutches machined in situ, which may suffer from a number of disadvantages including the amount of space needed for the clutch to operate and the complexity involved in and the time and costs associated with manufacturing the clutch.

In view of the foregoing challenges, examples according to this disclosure include a clutch apparatus configured for use in a downhole tool string. Clutches in accordance with this disclosure include components that do not need to be machined downhole within a tool string. The example clutches include a relatively compact configuration, which does not require additional space within a tool string conduit for engagement and disengagement. Additionally, in some examples, the clutch shares a component with the tool being milled out with the aid of the clutch. For example, the clutch may include an annular sleeve that is configured to engage and clutch to an annular housing of a tool string conduit. The sleeve can also be a component of a ball seat valve that is actuated to catch a dropped ball and to open a fluid pathway to a portion of formation surrounding the tool. In some such cases, the force that is applied to the ball to open the valve also functions to cause the sleeve of the clutch to engage with and clutch to the housing.

Clutches in accordance with this disclosure can include an annular housing including a shoulder extending radially inward from an inner surface of the housing and an annular sleeve received within the housing and configured to move longitudinally from a first position toward a second position within the housing in response to an applied force. The annular sleeve includes at least one tab protruding longitudinally from a first end of the sleeve. The annular sleeve is configured to allow the at least one tab of the sleeve to engage and at least partially penetrate the shoulder of the housing to inhibit relative rotation between the housing and sleeve.

As noted above and as described in the following examples, the annular sleeve of a clutch apparatus in accordance with this disclosure can also be the sleeve that forms a component of a ball seat valve. However, clutches in accordance with this disclosure can also be used in other applications different than those associated with ball seat valves. For example, clutches in accordance with this disclosure can also be used with a hydraulically activated packer utilizing a sliding piston. More generally tools utilizing a hydraulically activated piston which requires a locking feature can employ a clutch in accordance with this disclosure. In another example, a clutch in accordance with this disclosure could be employed with a down hole shut collar which is also a type of ball seat valve.

FIG. 1 is a schematic illustration of fracturing system 10 including tool string 12 arranged within wellbore 14, which passes through a number of layers of formation 18 of the well. Tool string 12 includes a number of ball seat valves 20 and packers 22. As will be described in more detail with reference to FIGS. 2-10, tool string 12 also includes one or more clutches configured to enable milling out different components of ball seat valves 20. Packers 22 seal off an annulus formed radially between tool string 12 and wellbore 14. Packers in this example are designed for sealing engagement with an uncased or open hole wellbore 14, but if the wellbore is cased or lined, then cased hole-type packers may be used instead. Swellable, inflatable, expandable, and other types of packers can be used, as appropriate for the well conditions, or no packers may be used.

In the FIG. 1 example, ball seat valves 20 permit selective fluid communication between the central passageway of tool string 12 and each section of the annulus isolated between two of the packers 22, which are located above and below each of the valves in wellbore 14. Each such section of the annulus surrounding tool string 12 is in fluid communication with a corresponding earth formation zone or layer of formation 18. Of course, if packers 22 are not used, then ball seat valves 20 can be placed in communication with the individual zones by other mechanisms, for example, with perforations, etc.

The zones of formation 18 can be, for example, sections of the same formation, or they may be sections of different formations. Each zone may be associated with one or more of ball seat valves 20. In order to carry out a fracturing operation on a particular one of the zones of formation 18, the associated ball seat valve 20 can be opened to allow communication between the central passageway of tool string 12 and the associated zone.

For example, one of ball seat valves 20 can be activated by dropping a ball into tool string 12 from the surface of the well. The dropped ball descends through the conduit forming string 12 within wellbore 14 until it lodges in a seat of valve 20. After the ball lodges in the ball seat, fluid flow through the central passageway of tool string 12 becomes restricted, a condition that allows fluid pressure to be applied from the surface of the well for purposes of exerting a downward force on the ball. Additionally, after the ball lodges in the ball seat, ball seat valve 20 can be opened to allow communication between the central passageway of tool string 12 and the associated zone of formation 18.

In some situations it may be necessary or desirable to remove one or more components of ball seat valve 20 after the valve has been actuated. In some cases, the ball dropped into the seat of valve 20 may be removed without requiring complex downhole tooling. However, in other cases, the ball, seat, and/or other components of ball seat valve 20 may need to be milled out to clear the conduit of tool string 12. As such, tool string 12 can include a clutch that is configured to enable milling out components of ball seat valve 20. The clutch can be employed to resist torque during the mill out operation so that the component that is being milled out does not rotate relative to the conduit within which the component is arranged. For example, the clutch can be employed so that the seat and ball of ball seat valve 20 do not rotate relative to the conduit of tool string 12.

Figure 2:
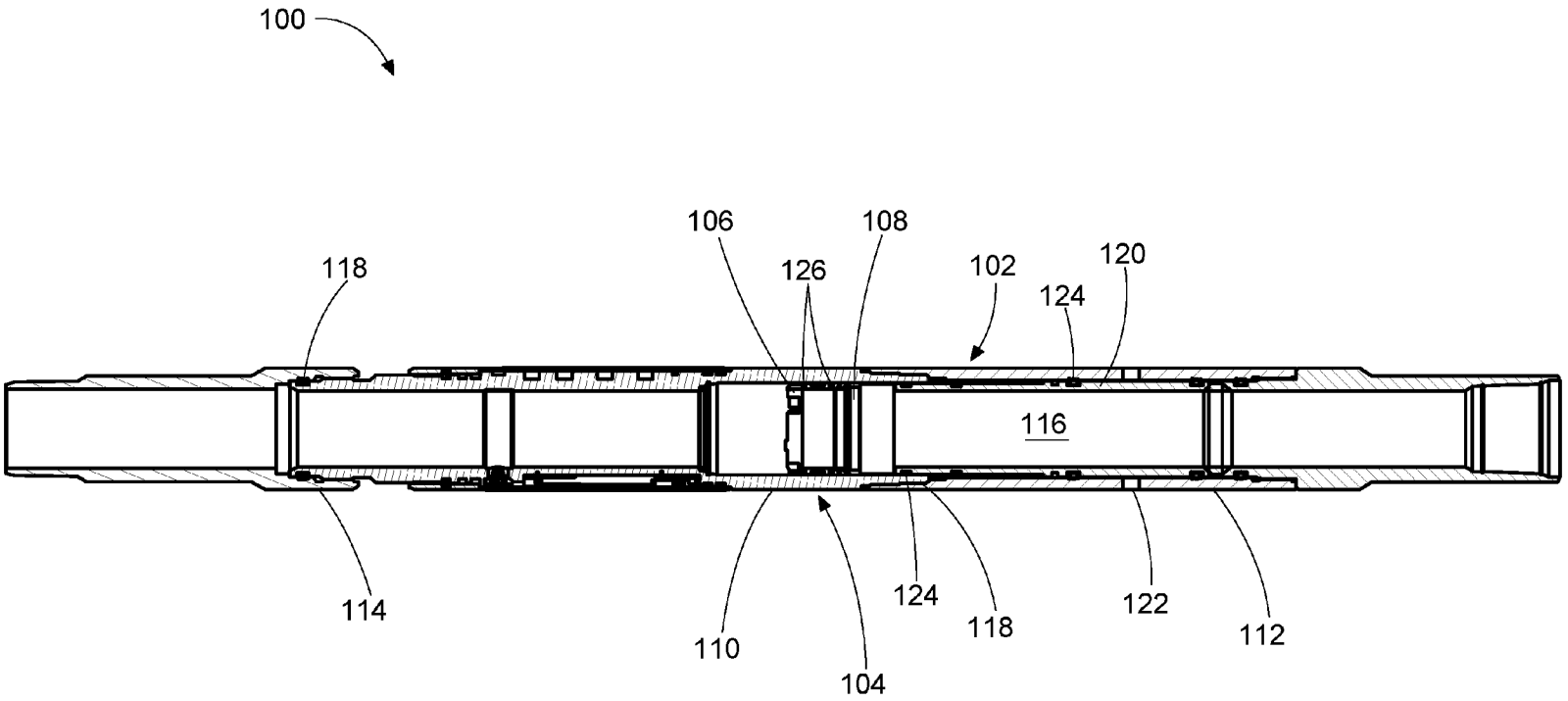
FIGS. 2 and 3 depict section views of portions of a tool string including an example clutch in accordance with this disclosure.
Figure 3:
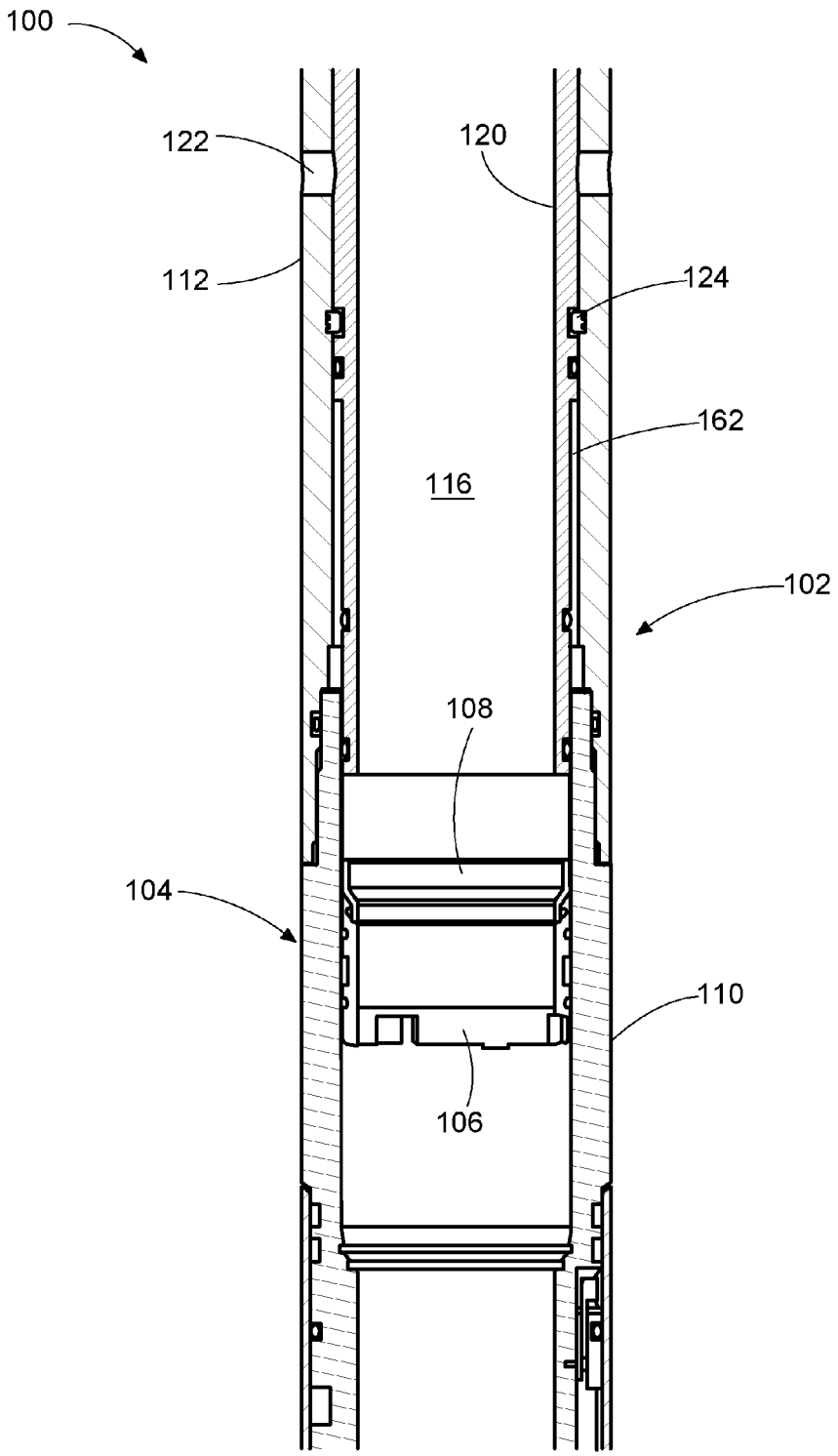

FIGS. 2 and 3 depict section views of portions of tool string 100 including a ball seat valve 102 and example clutch 104 in accordance with this disclosure. In the example of FIG. 2, ball seat valve 102 includes sleeve 106 and seat 108. Clutch 104 includes sleeve 106 received within housing 110. Housing 110 forms a portion of the central conduit of the tool string 100.

Tool string 100 includes a number of sections defined by different cylindrical housings connected to one another. The example of FIG. 2 shows only a portion of tool string 100 and it is noted that tool string 100 can include a number of additional portions, one or more of which can include additional ball seat valves and clutches in accordance with this disclosure, similar to example tool string 12 illustrated in FIG. 1.

In FIG. 2, tool string 100 includes housing 110, within which sleeve 106 of ball seat valve 102 and clutch 104 is arranged. Housing 110 is coupled above to upper housing 112 and below to lower housing 114. Housings of tool string 100, including housings 110, 112, and 114, can be coupled to one another in a variety of ways, including, e.g., threaded or spline connections, interference fits, and other mechanisms for connecting such components. Housings 110, 112, and 114 form a hollow generally cylindrical casing of tool string 100 that defines central conduit 116, by which fluids can be communicated from the surface, down a wellbore within which tool string 100 is deployed.

Housings 110, 112, and 114, as well as other components of tool string 100 like sleeve 106 can be sealed to one another employing various types of sealing mechanisms configured to inhibit ingress and egress of fluids and other materials into and out of central conduit 116 of tool string 100. For example, junctions between housing 110 and 112 and housing 110 and 114 include one or more O-ring seals 118.

Clutch 104 includes sleeve 106 received within housing 110. Sleeve 106 is received within housing 110 such that the outer surface of sleeve 106 abuts the inner surface of housing 110. Sleeve 106 is configured to move longitudinally within housing 110. The central passageway of sleeve 106 forms part of central conduit 116 of tool string 100. As will be described in more detail below, sleeve 106 of clutch 104 is configured to move within housing 110 and to engage and clutch to housing 110.

Clutch 104 can be engaged within tool string 100 using a variety of mechanisms. As described above, clutch 104 includes sleeve 106, which is configured to engage and clutch to housing 110. Sleeve 106 is also one component of ball seat valve 102. In some such cases, the force that is applied to the ball to open valve 102 also functions to cause sleeve 106 to engage with and clutch to housing 110.

In another example, a separate actuator can be employed to engage clutch 104. For example, tool string 100 includes piston 120, which can be configured to engage clutch 104. Piston 120 is arranged and configured to move within upper housing 112. Piston 120 can be actuated to move down and push sleeve 106 into engagement with housing 110. In the example of FIG. 2, multiple O-rings 124 circumscribe the outer surface of piston 120 and form corresponding annular seals between the outer surface of piston 120 and the inner surface of upper housing 112.

Movement of piston 120 within tool string 100 can be achieved with a variety of mechanical or electromechanical mechanisms. In one example, piston 120 is dropped within upper housing 112 to engage sleeve 106 using a hydraulic mechanism. In FIG. 3, a small chamber 162 is defined between a portion of the outer surface of piston 120 and the inner surface of upper housing 112. Chamber 162 can be filled with a hydraulic fluid such that the presence of the incompressible fluid prevents piston 120 from being pushed downward within upper housing 112. During fracturing operations using tool string 100, the pressure within central conduit 116 remains relatively high, e.g., approximately 2000 psi or more when fracking fluid is not being actively transmitted under pressure through the conduit. Thus, in the absence of the hydraulic fluid in chamber 162, piston 120 would be pushed by the pressure in central conduit 116 from the position in FIG. 5 down to the position in FIG. 6.

In one example, therefore, piston 120 is dropped within upper housing 112 to engage split-ring baffle 108 by evacuating the hydraulic fluid from chamber 162. When the hydraulic fluid in chamber 162 is removed or substantially removed, the pressure within chamber 162 holding piston 120 in position is reduced, creating a pressure imbalance between the pressure within central conduit 116 of tool string 100 and chamber 162 that causes piston 120 to move down within upper housing 112. Eventually piston 120 engages split-ring baffle 108 and moves baffle 108 into the contracted, ball-catching state illustrated in FIG. 6.

The hydraulic fluid can be removed from chamber 162 to actuate piston 120 in a variety of ways. In one example, the hydraulic fluid is evacuated from chamber 162 by piercing a membrane that covers an outlet port of chamber 162. However, in another example, a small mechanical door or valve can be actuated to open a fluid outlet to remove the hydraulic fluid from chamber 162. For example, an electromagnetic mechanism can be employed to pierce the membrane to evacuate the hydraulic fluid from chamber 162 and, thereby, actuate piston 120.

In one example, to actuate piston 120, a magnetic device is deployed within a chamber or other passage in tool string 100 that is adjacent to an actuator that is employed to evacuate the hydraulic fluid from chamber 162. The magnetic device can be a ferromagnetic cylinder or other shaped ferromagnetic material like a ball, dart, plug, fluid, gel, etc. In one example, a ferrofluid, magnetorheological fluid, or any other fluid having magnetic properties could be pumped to or past a magnetic sensor in order to transmit a magnetic signal to the actuator. Once deployed, the signal(s) generated by the magnetic device can be detected by a magnetic sensor in tool string 100.

In the event the magnetic sensor detects a signature signal that corresponds to deployment of the magnetic device, electronics incorporated into tool string 100 can be configured to engage the actuator to open the valve, which functions to evacuate the hydraulic fluid from chamber 162 to actuate piston 120 to move within housing 112. For example, if the electronic circuitry determines that the sensor has detected a predetermined magnetic signal(s), the electronic circuitry causes a valve device to open. In one example, the valve device includes a piercing member which pierces the membrane that covers an outlet port of chamber 162. The piercing member that is engaged to pierce the membrane sealing chamber 162 can be driven by any means, such as, by an electrical, hydraulic, mechanical, explosive, chemical or other type of actuator. Additional details about and examples of such electro-hydraulic valves are described in U.S. Publication No. 2013/0048290, entitled "INJECTION OF FLUID INTO SELECTED ONES OF MULTIPLE ZONES WITH WELL TOOLS SELECTIVELY RESPONSIVE TO MAGNETIC PATTERNS," which was filed on Aug. 29, 2011.

In another example, clutch 104 can be engaged by a tool deployed from the surface downhole within tool string 100. For example, a mill deployed to mill out one or more components of ball seat valve 102 may also be configured to engage clutch 104 prior to the mill out operation. A variety of other mechanisms can also be employed to apply the necessary force to sleeve 106 of clutch 104 to cause the sleeve to move down and engage housing 110.

Figure 4:
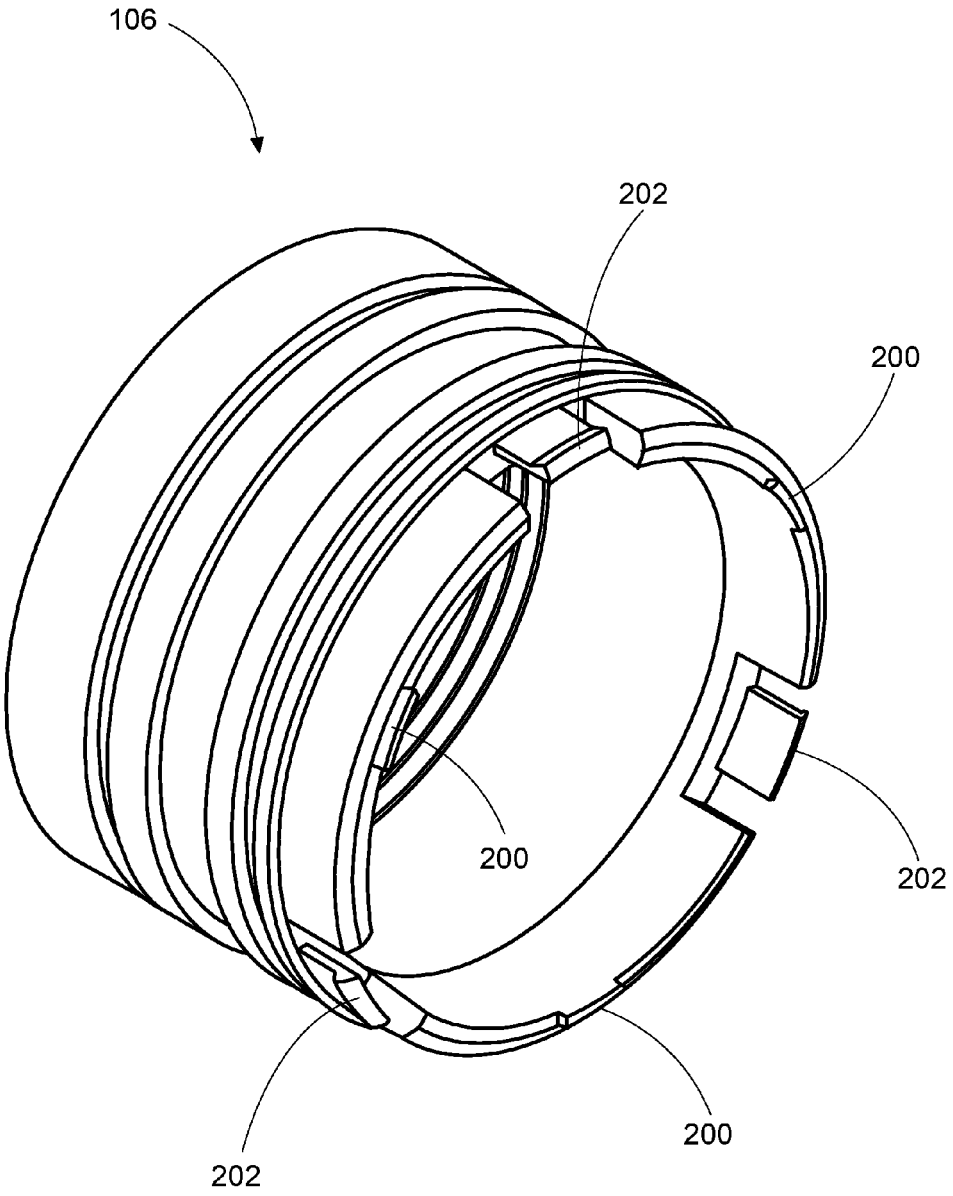
FIG. 4 is a perspective view of an annular sleeve that forms one component of a clutch in accordance with this disclosure.

Referring to FIG. 4, annular sleeve 106 of clutch 104 is depicted in more detail. In FIG. 4, sleeve 106 of clutch 104 includes tabs 200 and hooks 202. Tabs 200 protrude longitudinally from one end of sleeve 106 and are distributed approximately evenly around the circumference of the sleeve. Example sleeve 106 of clutch 104 includes three tabs 200. However, in other examples, an annular sleeve of a clutch in accordance with this disclosure can include more or fewer tabs and such tabs can be evenly or unevenly distributed around the circumference of one end of the sleeve. The number of tabs can be selected based at least in part on the rotational forces encountered by the clutch, e.g., during a mill out operation. For example, to resist higher torques during a mill out operation, the annular sleeve of the clutch can include more tabs.

Hooks 202 are also distributed evenly around and define portions of the circumference of the end of sleeve 106 including tabs 200. Hooks 202 are interposed circumferentially between tabs 200. Example sleeve 106 of clutch 104 includes three hooks 202. However, in other examples, an annular sleeve of a clutch in accordance with this disclosure can include more or fewer hooks and such hooks can be evenly or unevenly distributed around the circumference of one end of the sleeve. The number of hooks can be selected based at least in part on the axial forces encountered by the clutch, e.g., as a result of fluid pressure within the conduit of a tool string within which the clutch is arranged. For example, to resist higher pressures during fracturing operations on a formation, the annular sleeve of the clutch can include more hooks.

Figure 5A:
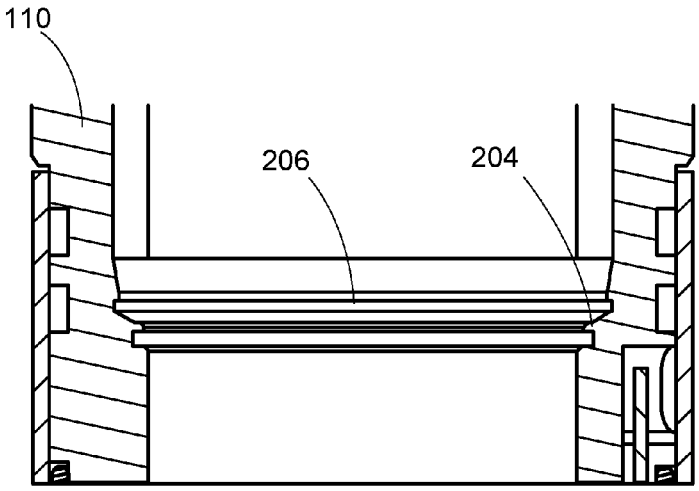
FIGS. 5A and 5B are section views of an annular housing that forms one component of a clutch in accordance with this disclosure.
Figure 5B:
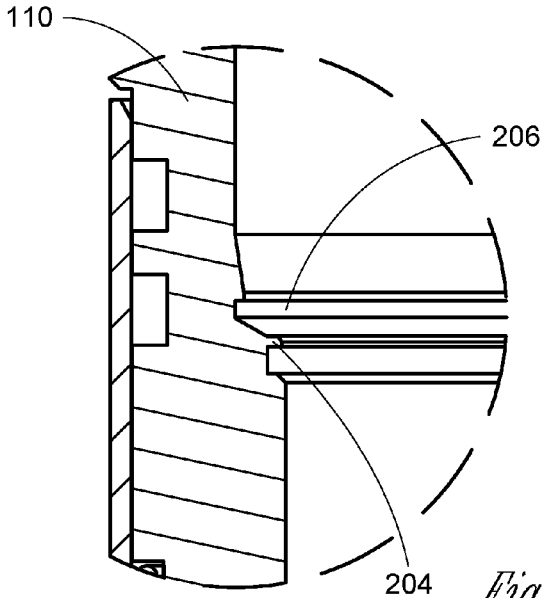

FIGS. 5A and 5B are section views illustrating a portion of housing 110, which forms the second component of clutch 104. In FIGS. 5A and 5B, housing 110 includes shoulder 204 and groove 206. Shoulder 204 protrudes radially inward from the inner surface of housing 110. Groove 206 defines a radially outward recess in the inner surface of housing 110 above shoulder 204.

In practice, an actuation force can an act upon sleeve 106 of clutch 104 to cause sleeve 106 to move within and engage housing 110 to prevent relative rotation and axial translation between housing 110 and sleeve 106. For example, annular sleeve 106 is configured to move longitudinally from a first position toward a second position within housing 110 in response to an applied force. When sleeve 106 moves from the first position to the second position, tabs 200 engage and at least partially penetrate shoulder 204 to inhibit relative rotation between housing 110 and sleeve 106. Additionally, when sleeve 106 is in the second position, hooks 202 of sleeve 106 to catch groove 206 in the inner surface of housing 110 to inhibit relative longitudinal translation between sleeve 106 and housing 110.

Figure 6:
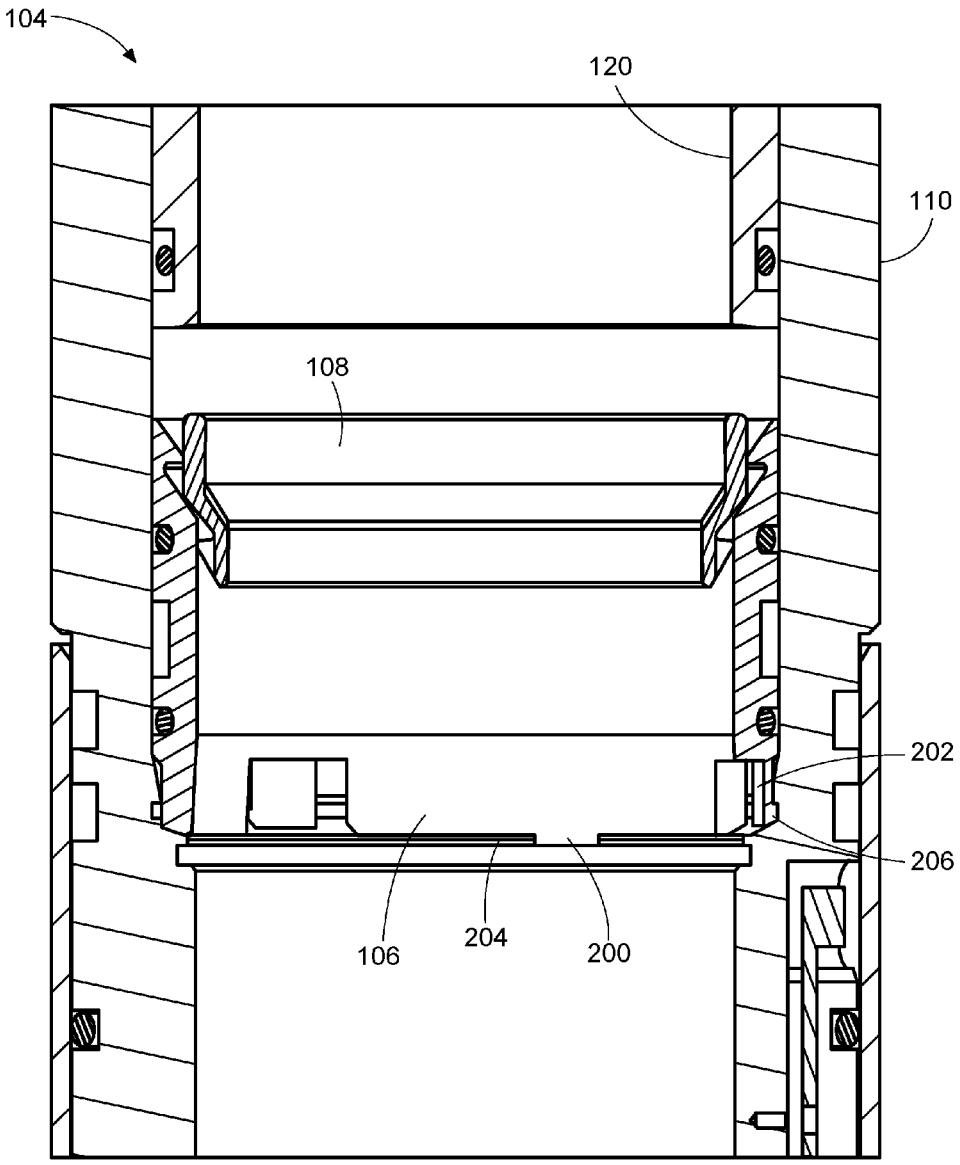
FIGS. 6 and 7 are section views of a portion of a tool string including a clutch, which illustrate engagement of a sleeve within a housing to inhibit relative rotation and axial translation between the sleeve and the housing.
Figure 7:
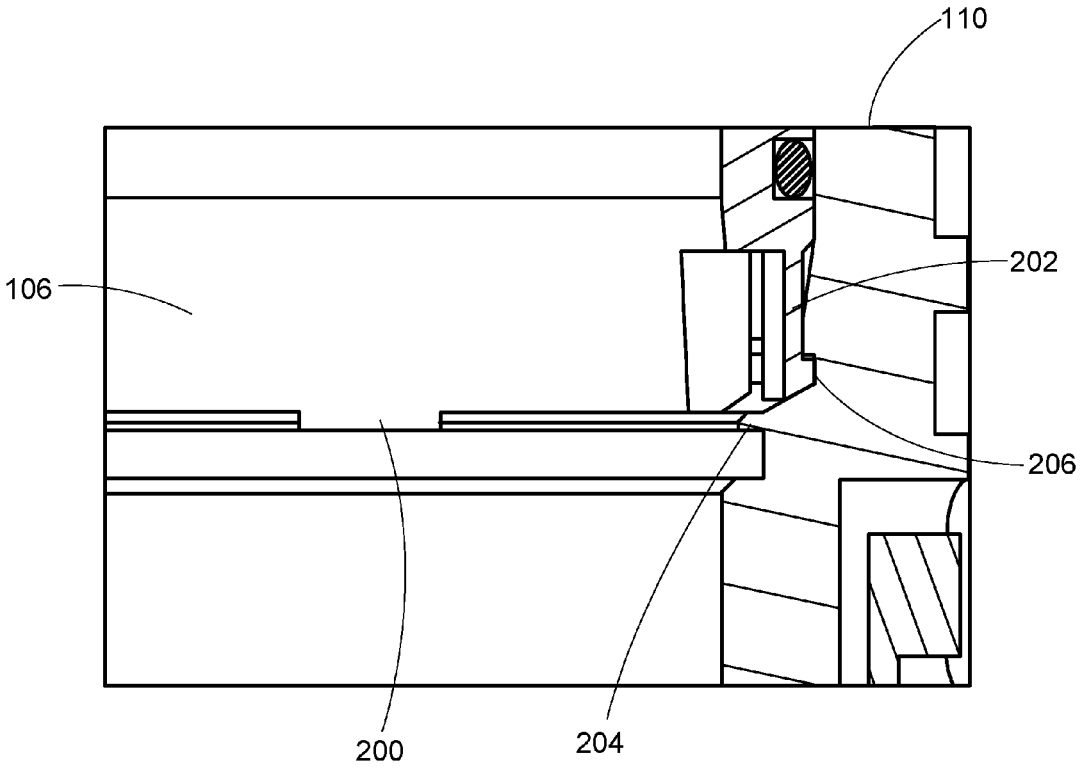

FIGS. 6 and 7 illustrate sleeve 106 in the second position within housing 110, in which tabs 200 and hooks 202 of sleeve 106 are engaged with shoulder 204 and groove 206, respectively, of housing 110. As illustrated in FIGS. 6 and 7, tabs 200 engage and at least partially penetrate shoulder 204. Penetration of shoulder 204 of housing 110 by tabs 200 of sleeve 106 inhibits relative rotation between housing 110 and sleeve 106. In this example, tabs 200 pierce through shoulder 204. However, as will be described below with reference to FIGS. 8-10B, other example clutches in accordance with this disclosure may include an annular sleeve with tabs that are configured to only partially penetrate a shoulder of the housing within which the sleeve is arranged.

In FIGS. 6 and 7, in addition to tabs 200 piercing shoulder 204, hooks 202 of sleeve 106 catch groove 206 in the inner surface of housing 110. When hooks 202 of sleeve 106 catch grooves 206 of housing 110, hooks 202 function to inhibit relative longitudinal translation between sleeve 106 and housing 110. Hooks 202 can be fabricated from a resilient material, e.g., a resilient metallic alloy. In some examples, sleeve 106 and hooks 202 are fabricated from the same alloy as split-ring baffle 108, including, e.g., SAE steel grades 4140 or 4130, an austenitic nickel-chromium alloy, or a martensitic stainless steel. Hooks 202 include a tapered outer surface that is configured to engage a tapered surface of groove 204 such that, when sleeve 106 moves down within housing 110, hooks 202 initially deflect radially inward as the tapered surface of hooks 202 engage the tapered surface of groove 204 and then hooks 202 resiliently deflect radially outward and catch in groove 204.

As noted above, in one example, the force generated above ball seat valve 120 after a ball has been lodged in seat 108 can also cause sleeve 106 of clutch 104 to engage and clutch to housing 110. For example, after the ball lodges in seat 108, fluid flow through central conduit 116 of tool string 100 becomes restricted, a condition that allows fluid pressure to be applied from the surface of the well for purposes of exerting a downward force on the ball. Fluid pressure generated during fracturing operations can reach relatively high levels of between approximately 3000 to approximately 5000 psi. Seat 108 in which the ball is lodged is attached to sleeve 106 of clutch 104. Fluid pressure on the ball is transferred to sleeve 106, which can cause sleeve 106 to move within housing 110 and cause tabs 200 to engage and at least partially penetrate shoulder 204 to clutch sleeve 106 to housing 110. Additionally, the movement of sleeve 106 can also cause hooks 202 to catch groove 206 in the inner surface of housing 110 to inhibit relative longitudinal translation between sleeve 106 and housing 110.

Ball seat 108 of valve 102 is, more generally, a baffle, configured to receive a ball (or other plug) to substantially block movement of fluids through the conduit of a wellbore. As illustrated in more detail in FIG. 6, ball seat 108 of valve 102 can include a split-ring baffle. Split-ring baffle 108 is at least partially received within sleeve 106. Split-ring baffle 108 is longitudinally moveable between a first position and a second position within sleeve 106. The outer surface of split-ring baffle 108 is configured to engage the inner surface of sleeve 106 to cause baffle 108, when in the first position to be relatively radially expanded (FIG. 3), and, when moved to the second position in the sleeve, to radially contract (FIG. 6). The function and structure of a split-ring baffle that can be employed in ball seat valves that coordinate function with clutches in accordance with this disclosure is described in U.S. application Ser. No. 13/958,122, by the same inventor, entitled "METHOD AND APPARATUS FOR RESTRICTING FLUID FLOW IN A DOWNHOLE TOOL," filed on Aug. 2, 2013. Although clutch 104 is described and illustrated in conjunction with ball seat valve 102 including split-ring baffle 108, in other examples, clutches in accordance with this disclosure can be employed with valves including other types of ball seats/baffles; and as noted earlier herein with tools and mechanisms other than ball seat valves.

Ball seat valve 102 is configured to be opened and closed and split-ring baffle 108 of valve 102 is configured to be contracted and re-expanded within sleeve 106. Removal of the ball from and re-expansion of split-ring baffle 108 is important to operation of tool string 100 to provide the maximum size of central conduit 116 of string 100 for subsequent operations. Additionally, as noted above, after ball seat valve 102 has been actuated to carry out fracturing operations and clutch 104 has been engaged, one or more of the ball, split-ring baffle 108, and/or sleeve 106 may need to be milled out. Clutch 104 is configured to resist torque during the mill out operation so that the ball, baffle 108, and sleeve 106 do not rotate relative to housing 110.

In order to re-open valve 102, the ball must be dislodged from split-ring baffle 108. In practice, the ball can be dislodged from split-ring baffle 108 in a number of ways. In one example, the ball is dislodged from split-ring baffle 108 by back-pressure within conduit 116 of tool string 100 after fracturing operations on a zone associated with valve 102 are completed. After completing fracturing operations on the zone, the fluid pressure employed to communicate the fracking fluid through tool string 100 is reduced. However, pressure below ball seat valve 102 remains significant. In practice, this can create a pressure imbalance that creates a net positive pressure below ball seat valve 102, which can push on and cause the ball to become dislodged from split-ring baffle 108. As the ball is dislodged from split-ring baffle 108, the ball can also function to pull baffle 108 upward within sleeve 106. Thus, dislodging the ball from baffle 108 can also cause baffle 108 to move upward within sleeve 106 and radially re-expand.

In some cases, however, the back-pressure within conduit 116 after fracturing operations are completed is not sufficient to dislodge the ball and/or re-expand baffle 108. In such cases, the ball and/or baffle 108 must be milled out of conduit 116. Additionally, in some circumstances, it may be necessary or desirable to mill out Clutch 104 can be engaged in this event to resist the torques generated from the milling operation on the ball and/or baffle 108.

FIGS. 8-10B depict an alternative clutch 300 in accordance with this disclosure. The manner in which clutch 300 is engaged and operates within a tool string can be the same or substantially similar as that described above with reference to example clutch 104. Additionally, as with clutch 104 and ball seat valve 102, clutch 300 may operate in conjunction with a ball seat valve including a split-ring or other type of baffle.

Figure 8:
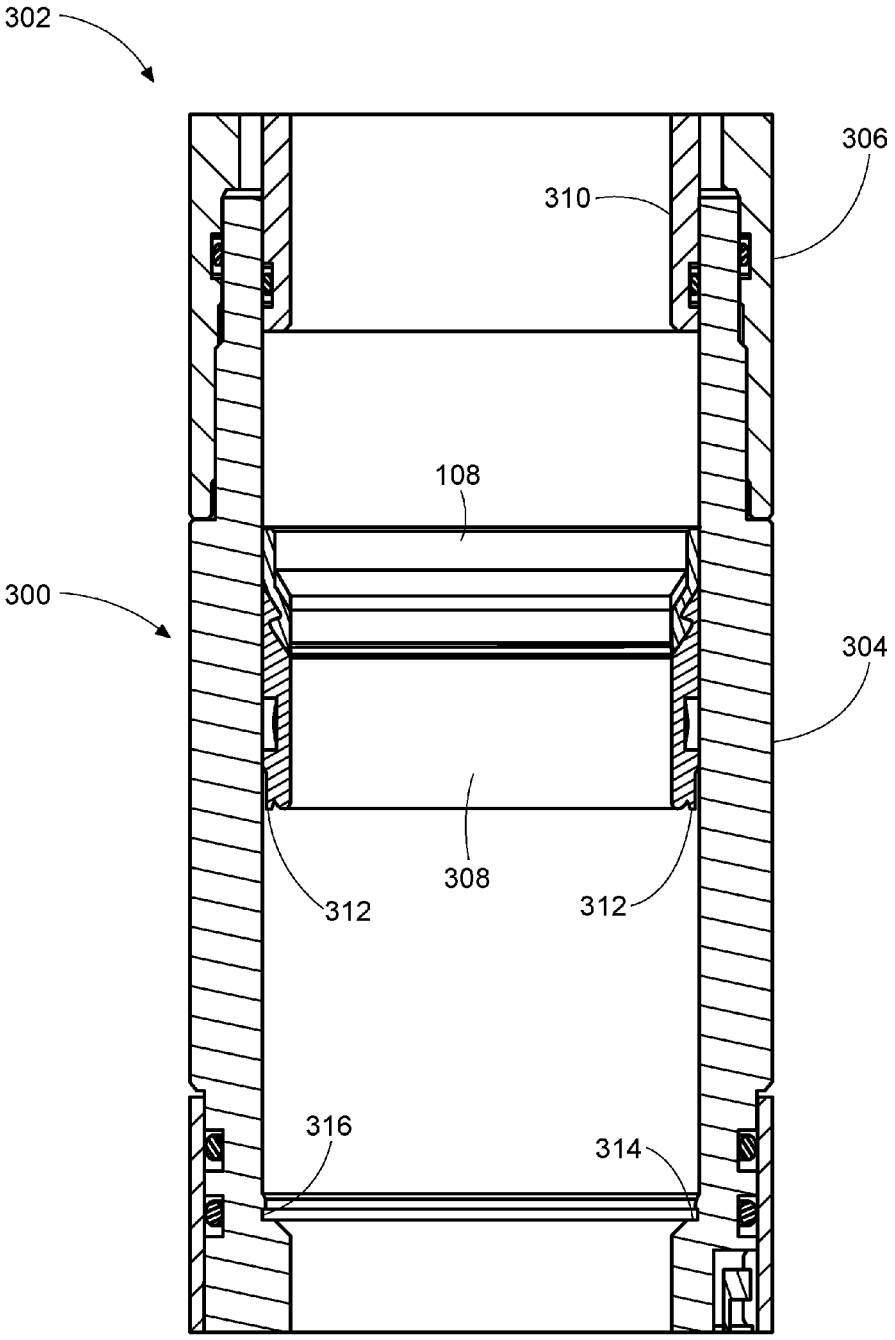
FIG. 8 is a section view of a portion of a tool string including another example clutch.
Figure 10A:
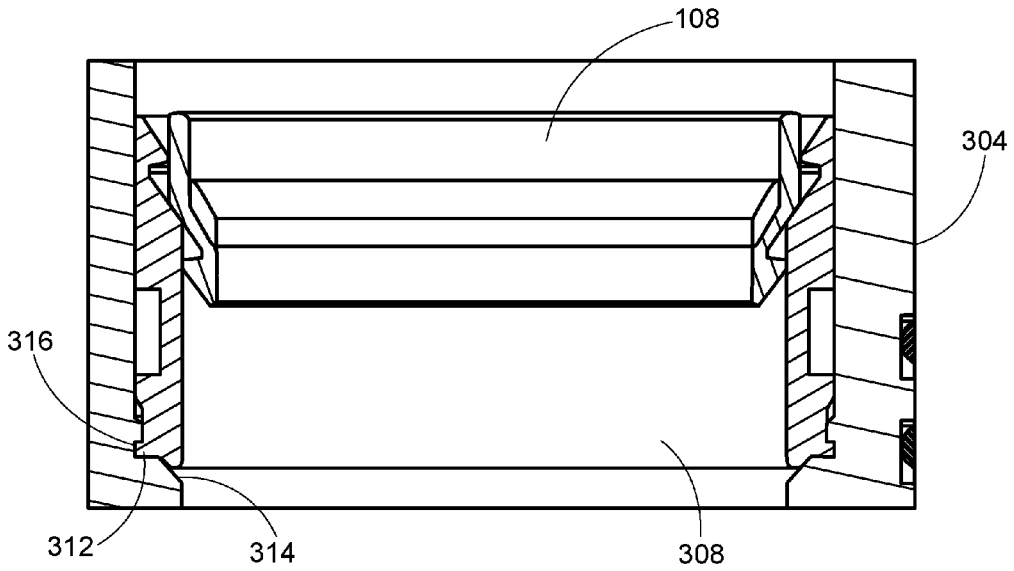
FIGS. 10A and 10B are section views of the clutch of FIG. 7, which illustrate engagement of a sleeve within a housing to inhibit relative rotation and axial translation between the sleeve and the housing.
Figure 10B:
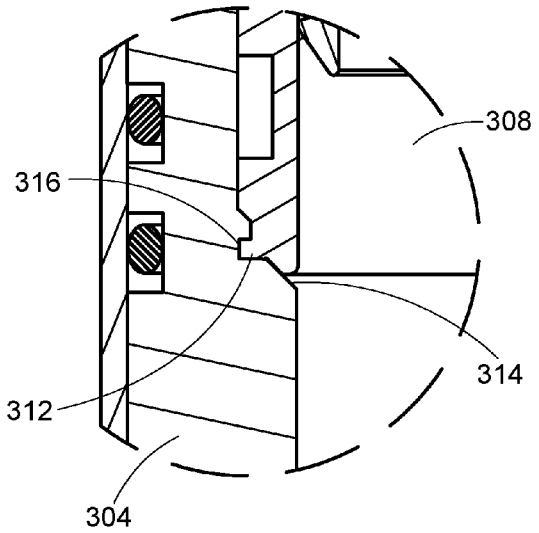

FIG. 8 depicts a section view of a portion of tool string 302 including housing 304, upper housing 306, and clutch 300. Clutch 300 includes housing 304 and annular sleeve 308. Annular sleeve 308 is arranged within housing 304 such that the outer surface of sleeve 308 abuts the inner surface of housing 304. Annular sleeve 308 is configured to move axially within housing 304 from a position in which sleeve 308 is unengaged with housing 304, as illustrated in FIG. 8, to a position in which sleeve 308 is clutched to housing 304, as illustrated in FIGS. 10A and 10B.

For example, sleeve 308 is configured to move longitudinally from a first position toward a second position within housing 304 in response to an applied force, including, e.g., in response to fluid pressure or another actuation mechanism like piston 310. Annular sleeve 308 includes at least one tab 312 protruding longitudinally from one end of sleeve 308. Housing 304 includes shoulder 314, which extends radially inward from the inner surface of housing 304. Sleeve 308 is moveable from the first position (FIG. 8) to the second position (FIGS. 10A and 10B) to cause the at least one tab 312 to engage and at least partially penetrate shoulder 314 of housing 304. Tab(s) 312 of example sleeve 308 is configured to inhibit relative rotation and longitudinal translation between housing 304 and sleeve 308.

Figure 9:
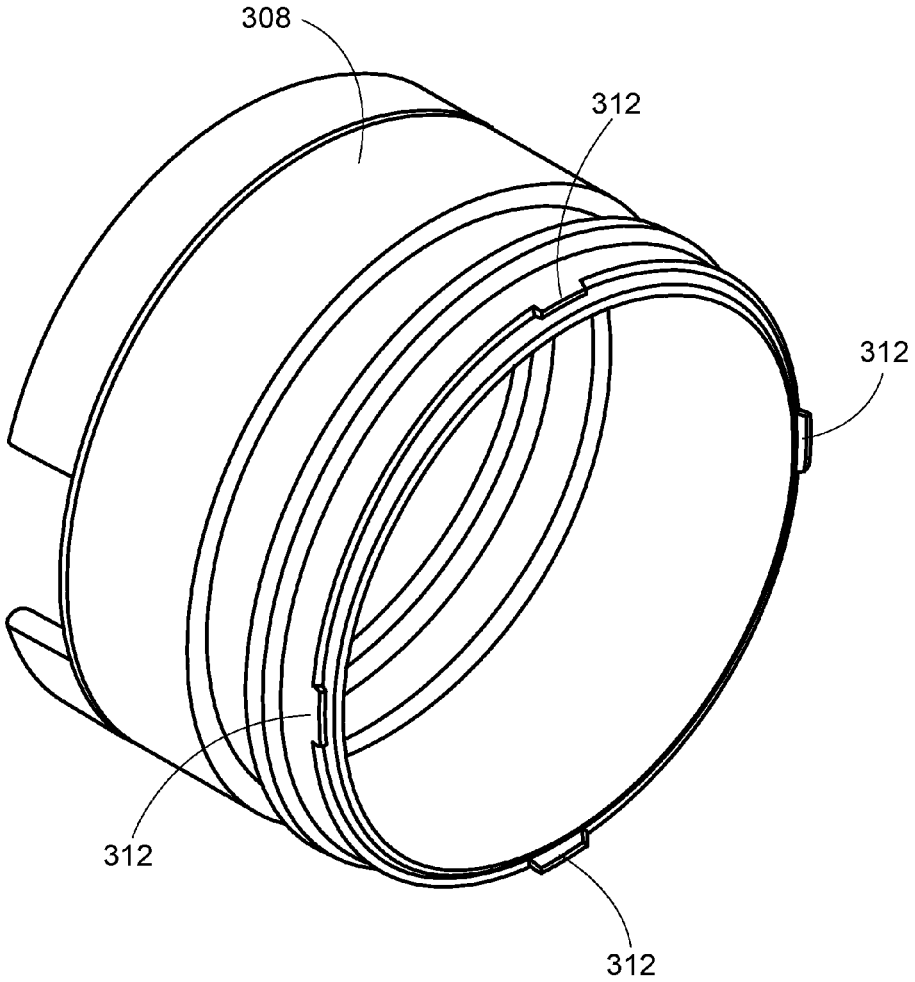
FIG. 9 is a perspective view of an annular sleeve of the example clutch of FIG. 11.

Additional details regarding the configuration of annular sleeve 308 are illustrated in the perspective view of FIG. 9. As illustrated in FIG. 9, example sleeve 308 includes four tabs 312 protruding longitudinally from and evenly distributed around the circumference of one end of sleeve 308. However, in other examples, an annular sleeve of a clutch in accordance with this disclosure can include more or fewer tabs and such tabs can be evenly or unevenly distributed around the circumference of one end of the sleeve. The number of tabs can be selected based at least in part on the rotational and axial forces encountered by the clutch, e.g., during a mill out operation.

Tabs 312 of sleeve 308 are configured to engage housing 304 to inhibit both relative rotation and longitudinal translation between housing 304 and sleeve 308. FIGS. 10A and 10B depict sleeve 308 moved downward within and clutched to housing 304. As noted, the force applied to sleeve 308 to cause sleeve 308 to move within and clutch to housing 304 can be applied by a number of different mechanisms. In one example, the force generated above a ball seat valve including split-ring baffle 108 and sleeve 308 after a ball has been lodged in baffle 108 can also cause sleeve 308 of clutch 300 to engage and clutch to housing 304. In another example, piston 310, which may also function to move split-ring baffle 108 into the contracted, ball-catching state, also can be configured to cause sleeve 308 to move within housing 304 and cause tabs 312 to clutch sleeve 308 to housing 304.

Regardless of the manner in which sleeve 308 moves into engagement with housing 304, when sleeve 308 is pushed longitudinally within housing 304 until tabs 312 engage and at least partially penetrate shoulder 314 of housing 304, tabs 312 deform at least partially into groove 316 in the inner surface of housing 304, as illustrated in FIGS. 10A and 10B. Example sleeve 308 is configured such that tabs 312 are configured to only partially penetrate shoulder 314, or, as it is sometimes described, tabs 312 are configured to "coin" into shoulder 314. Tabs 312 of sleeve 308 partially penetrating shoulder 314 housing 304 can function to inhibit relative rotation between housing 304 and sleeve 308. Deformation of at least a portion of tabs 312 into groove 316 in housing 304, on the other hand, can function to inhibit relative longitudinal translation between sleeve 308 and housing 304. In this manner, tabs 312 of annular sleeve 308 are configured to engage housing 304 to inhibit both relative rotation and longitudinal translation between housing 304 and sleeve 308.

Figure 11:
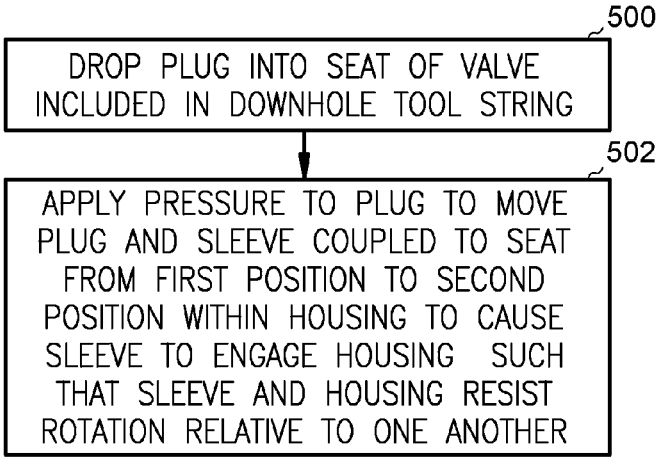
FIG. 11 is a flowchart illustrating a method of engaging a clutch in a downhole tool string.

FIG. 11 is a flowchart illustrating a method of engaging a clutch in a downhole tool string. The example method of FIG. 11 includes dropping a plug into a seat of a valve included in the tool string (500) and applying pressure to the plug to move the plug and the sleeve from a first position to a second position within the housing to cause the sleeve to engage the housing such that the sleeve and the housing resist rotation relative to one another (502). The seat of the valve is coupled to an annular sleeve received within an annular housing and configured to move longitudinally from a first position toward a second position within the housing in response to an applied force. The housing includes a shoulder extending radially inward from an inner surface of the housing. The sleeve includes at least one tab protruding longitudinally from a first end of the sleeve. The sleeve is moveable from the first position to the second position in response to the applied pressure to cause the at least one tab of the sleeve to engage and at least partially penetrate the shoulder of the housing to inhibit relative rotation between the housing and sleeve.

The method of FIG. 11 may form part or all of the process by which clutch 104 or clutch 300 are engaged downhole within a tool string. An example of the method of FIG. 11 is described above with reference to FIGS. 6 and 7, which illustrate movement of annular sleeve 106 of clutch 104 downward within housing 110 to cause tabs 200 of sleeve 106 to pierce through shoulder 204 of housing 110 to inhibit relative rotation between housing 110 and sleeve 106. Another example of the method of FIG. 11 is described above with reference to FIGS. 8, 10A, and 10B, which illustrate movement of annular sleeve 308 of clutch 300 downward within housing 304 to cause tabs 312 of sleeve 106 to partially penetrate shoulder 204 and partially deform into groove 316 of housing 304 to inhibit relative rotation and longitudinal translation between housing 304 and sleeve 308.

Various examples have been described. These and other examples are within the scope of the following claims.

I claim:

1. A clutch configured for use in a downhole tool string, the clutch comprising:

an annular housing comprising a shoulder extending radially inward from an inner surface of the housing; and an annular sleeve received within the housing and configured to move longitudinally from a first position toward a second position within the housing in response to an applied force, wherein the sleeve comprises at least one tab protruding longitudinally from a first end of the sleeve, and wherein the sleeve is moveable from the first position to the second position to cause the at least one tab of the sleeve to engage and at least partially penetrate the shoulder of the housing to inhibit relative rotation between the housing and sleeve, wherein, when the sleeve is pushed longitudinally within the housing until the at least one tab of the sleeve engages and at least partially penetrates the shoulder of the housing, the at least one tab deforms at least partially into a groove in the inner surface of the housing to inhibit relative rotation and longitudinal translation between the sleeve and the housing.

2. The clutch of claim 1, wherein the at least one tab of the sleeve comprises a plurality of tabs distributed around a circumference of and protruding longitudinally from the first end of the sleeve.

3. The clutch of claim 1, wherein the plurality of tabs are evenly distributed around the circumference of the first end of the sleeve.

4. The clutch of claim 1, wherein the plurality of tabs are unevenly distributed around the circumference of the first end of the sleeve.

5. The clutch of claim 1, wherein the plurality of tabs comprises three tabs that are evenly distributed around the circumference of the first end of the sleeve.

6. The clutch of claim 1, further comprising a resilient split-ring baffle at least partially received within the sleeve, the baffle comprising a longitudinal seam forming two separate circumferential ends in the baffle, the baffle being longitudinally moveable between a first position to a second position in the sleeve, wherein an outer surface of the baffle is configured to engage an inner surface of the sleeve to cause the baffle, when in the first position to be relatively radially contracted, and, when moved to the second position in the sleeve, to radially expand.

7. The clutch of claim 6, further comprising a plug that is configured to be received by and substantially prevent fluid flow through the baffle when the baffle is contracted, wherein the plug is configured to pass through the baffle when the baffle is expanded.

8. The clutch of claim 7, further comprising a fluid pressure applicator that, when the baffle is in the first position radially contracted and when the plug is received by and substantially prevents fluid flow through the baffle, is configured to apply fluid pressure to move the sleeve from the first position to the second position to cause the at least one tab of the sleeve to engage and at least partially penetrate the shoulder.

9. The clutch of claim 1, further comprising a piston received within the housing and configured to move longitudinally within the housing to move the sleeve from the first position to the second position to cause the at least one tab of the sleeve to engage and at least partially penetrate the shoulder.

10. A clutch configured for use in a downhole tool string, the clutch comprising:

an annular housing comprising a shoulder extending radially inward from an inner surface of the housing; and an annular sleeve received within the housing and configured to move longitudinally from a first position toward a second position within the housing in response to an applied force, wherein the sleeve comprises at least one tab protruding longitudinally from a first end of the sleeve, and wherein the sleeve is moveable from the first position to the second position to cause the at least one tab of the sleeve to engage and at least partially penetrate the shoulder of the housing to inhibit relative rotation between the housing and sleeve, wherein, when the sleeve is pushed longitudinally within the housing until the at least one tab of the sleeve engages and at least partially penetrates the shoulder of the housing, the at least one tab pierces through the shoulder of the housing to inhibit relative rotation between the sleeve and the housing.

11. The clutch of claim 10, wherein the sleeve comprises at least one resilient hook arranged toward the first end of the sleeve, and wherein, when the sleeve is pushed longitudinally within the housing until the at least one tab of the sleeve engages and at least partially penetrates the shoulder of the housing, the hook of the sleeve is configured to catch a groove in the inner surface of the housing to inhibit relative longitudinal translation between the sleeve and the housing in at least one direction.

12. An apparatus for communicating a fracturing fluid to one or more layers of a formation surrounding a subterranean wellbore, the apparatus comprising:

a tool string comprising a plurality of annular housings defining a central conduit of the tool string through which the fracturing fluid is communicated;

a clutch comprising:

one housing of the tool string, wherein the one housing comprises a shoulder extending radially inward from an inner surface of the housing; and an annular sleeve received within the housing and configured to move longitudinally from a first position toward a second position within the housing in response to an applied force, wherein the sleeve comprises at least one tab protruding longitudinally from a first end of the sleeve, and wherein the sleeve is moveable from the first position to the second position to cause the at least one tab of the sleeve to engage and at least partially penetrate the shoulder of the housing to inhibit relative rotation between the housing and sleeve, wherein, when the sleeve is pushed longitudinally within the housing until the at least one tab of the sleeve engages and at least partially penetrates the shoulder of the housing, the at least one tab deforms at least partially into a groove in the inner surface of the housing to inhibit relative rotation and longitudinal translation between the sleeve and the housing.

13. The apparatus of claim 12, wherein the at least one tab of the sleeve comprises a plurality of tabs distributed around a circumference of and protruding longitudinally from the first end of the sleeve.

14. The apparatus of claim 12, further comprising a resilient split-ring baffle at least partially received within the sleeve, the baffle comprising a longitudinal seam forming two separate circumferential ends in the baffle, the baffle being longitudinally moveable between a first position to a second position in the sleeve, wherein an outer surface of the baffle is configured to engage an inner surface of the sleeve to cause the baffle, when in the first position to be relatively radially contracted, and, when moved to the second position in the sleeve, to radially expand.

15. The apparatus of claim 14, further comprising a plug that is configured to be received by and substantially prevent fluid flow through the baffle when the baffle is contracted, wherein the plug is configured to pass through the baffle when the baffle is expanded.

16. The apparatus of claim 15, further comprising a fluid pressure applicator that, when the baffle is in the first position radially contracted and when the plug is received by and substantially prevents fluid flow through the baffle, is configured to apply fluid pressure to move the sleeve from the first position to the second position to cause the at least one tab of the sleeve to engage and at least partially penetrate the shoulder.

17. An apparatus for communicating a fracturing fluid to one or more layers of a formation surrounding a subterranean wellbore, the apparatus comprising:

a tool string comprising a plurality of annular housings defining a central conduit of the tool string through which the fracturing fluid is communicated;

a clutch comprising:

one housing of the tool string, wherein the one housing comprises a shoulder extending radially inward from an inner surface of the housing; and an annular sleeve received within the housing and configured to move longitudinally from a first position toward a second position within the housing in response to an applied force, wherein the sleeve comprises at least one tab protruding longitudinally from a first end of the sleeve, and wherein the sleeve is moveable from the first position to the second position to cause the at least one tab of the sleeve to engage and at least partially penetrate the shoulder of the housing to inhibit relative rotation between the housing and sleeve, wherein, when the sleeve is pushed longitudinally within the housing until the at least one tab of the sleeve engages and at least partially penetrates the shoulder of the housing, the at least one tab pierces through the shoulder of the housing to inhibit relative rotation between the sleeve and the housing.

18. The apparatus of claim 17, wherein the sleeve comprises at least one resilient hook arranged toward the first end of the sleeve, and wherein, when the sleeve is pushed longitudinally within the housing until the at least one tab of the sleeve engages and at least partially penetrates the shoulder of the housing, the hook of the sleeve is configured to catch a groove in the inner surface of the housing to inhibit relative longitudinal translation between the sleeve and the housing in at least one direction.

19. A method of engaging a clutch in a downhole tool string, the method comprising:

dropping a plug into a seat of a valve included in the tool string, wherein the seat is coupled to an annular sleeve received within an annular housing and configured to move longitudinally from a first position toward a second position within the housing in response to an applied force, and wherein the housing comprises a shoulder extending radially inward from an inner surface of the housing;

applying pressure to the plug to move the plug and the sleeve from the first position to the second position within the housing to cause the sleeve to engage the housing such that the sleeve and the housing resist rotation relative to one another, wherein the sleeve comprises at least one tab protruding longitudinally from a first end of the sleeve, and wherein the sleeve is moveable from the first position to the second position in response to the applied pressure to cause the at least one tab of the sleeve to engage and at least partially penetrate a shoulder of the housing to inhibit relative rotation between the housing and sleeve.

* * * * *